US009400115B2

(12) United States Patent
Kuwamura

(10) Patent No.: US 9,400,115 B2
(45) Date of Patent: Jul. 26, 2016

(54) BUILT-IN COOKING APPLIANCE AND KITCHEN COUNTER HAVING SAME

(75) Inventor: Hiroshi Kuwamura, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 2093 days.

(21) Appl. No.: 10/580,177

(22) PCT Filed: Nov. 9, 2005

(86) PCT No.: PCT/JP2005/020528

§ 371 (c)(1),
(2), (4) Date: Mar. 5, 2007

(87) PCT Pub. No.: WO2006/051812

PCT Pub. Date: May 18, 2006

(65) Prior Publication Data

US 2007/0169770 A1 Jul. 26, 2007

(30) Foreign Application Priority Data

Nov. 10, 2004 (JP) ..... 2004-326198

(51) Int. Cl.

| | |
|---|---|
| ***H05B 6/12*** | (2006.01) |
| ***H05B 3/68*** | (2006.01) |
| ***F24C 15/10*** | (2006.01) |
| ***A47B 77/08*** | (2006.01) |

(52) U.S. Cl.

CPC ..... *F24C 15/108* (2013.01); *A47B 77/08* (2013.01)

(58) Field of Classification Search

CPC ..... F24C 15/12; F24C 15/101; F24C 15/102; F24C 15/108; F24C 15/10; H05B 3/141; H05B 3/74; H05B 3/08; H05B 6/12; B29C 44/1219; B29C 44/1228; A47B 77/08

USPC ..... 219/620, 452.11, 443.1, 218, 454.12, 219/622, 451.1, 460.1, 626, 624, 454.11, 219/452.12, 453.12, 453.15, 456.1, 465.1, 219/468.2, 448.17; 126/211, 217, 218, 303, 126/30, 27, 37 R, 39 B, 37 A, 214 A, 214 C, 126/215

See application file for complete search history.

(56) References Cited

U.S. PATENT DOCUMENTS 3,612,827 A * 10/1971 Dills ..... 219/455.11
4,490,603 A * 12/1984 Fischer et al. ..... 219/456.1

(Continued)

FOREIGN PATENT DOCUMENTS

AU 524 301 9/1982
AU 664 796 11/1995

(Continued)

OTHER PUBLICATIONS

Patent Cooperation Treaty (PCT) International Preliminary Report on Patentability, issued May 15, 2007.

(Continued)

*Primary Examiner* — Hung D Nguyen

(74) *Attorney, Agent, or Firm* — Wenderoth, Lind & Ponack, L.L.P.

(57) ABSTRACT

A top plate unit includes a top plate on which an object to be heated is placed, an underframe for holding the top plate placed on an upper surface thereof, the underframe being adapted to be placed on an upper surface of a kitchen counter in a manner in which a lower surface of the underframe is held in contact with the upper surface of the kitchen counter, and a decorative panel 6 for covering an upper portion of an outer peripheral edge of the top plate. The decorative panel has an inwardly bent portion that has been formed by bending an outer peripheral edge portion of the decorative panel inwardly toward a lower surface of the underframe to hold the outer peripheral edge of the underframe.

20 Claims, 9 Drawing Sheets

(56) References Cited

U.S. PATENT DOCUMENTS

| | | | | |
|---|---|---|---|---|
| 5,429,114 | A * | 7/1995 | Taplan et al. | 126/211 |
| 5,446,268 | A * | 8/1995 | Chen | 219/623 |
| 5,640,947 | A * | 6/1997 | Shute | 126/211 |
| 5,791,336 | A * | 8/1998 | Helm | 126/39 H |
| 5,844,206 | A | 12/1998 | Steiner et al. | |
| 5,893,359 | A * | 4/1999 | Schultheis et al. | 126/214 A |
| 5,990,457 | A | 11/1999 | Steiner et al. | |
| 6,043,462 | A * | 3/2000 | Stedron et al. | 219/452.11 |
| 6,175,102 | B1 * | 1/2001 | Stedron et al. | 219/452.11 |
| 6,207,933 | B1 * | 3/2001 | Stedron et al. | 219/452.11 |
| 6,207,934 | B1 * | 3/2001 | Steiner et al. | 219/452.11 |

FOREIGN PATENT DOCUMENTS

| | | |
|---|---|---|
| DE | 30 18 680 | 12/1981 |
| EP | 37037 | 10/1981 |
| EP | 0 748 676 | 12/1996 |
| EP | 0 928 401 | 7/1999 |
| GB | 2 277 146 | 10/1994 |
| JP | 64-41006 | 3/1989 |
| JP | 9-303792 | 11/1997 |
| JP | 11-166739 | 6/1999 |
| JP | 2002-270353 | 9/2002 |
| JP | 2003-74877 | 3/2003 |
| JP | 2004-031345 | 1/2004 |
| JP | 2004-233000 | 8/2004 |
| JP | 2004-311338 | 11/2004 |
| WO | 98/12481 | 3/1998 |

OTHER PUBLICATIONS

Extended European Search Report issued Oct. 30, 2014 in corresponding European Application No. 05806158.1.

* cited by examiner

*Fig. 8* Prior Art
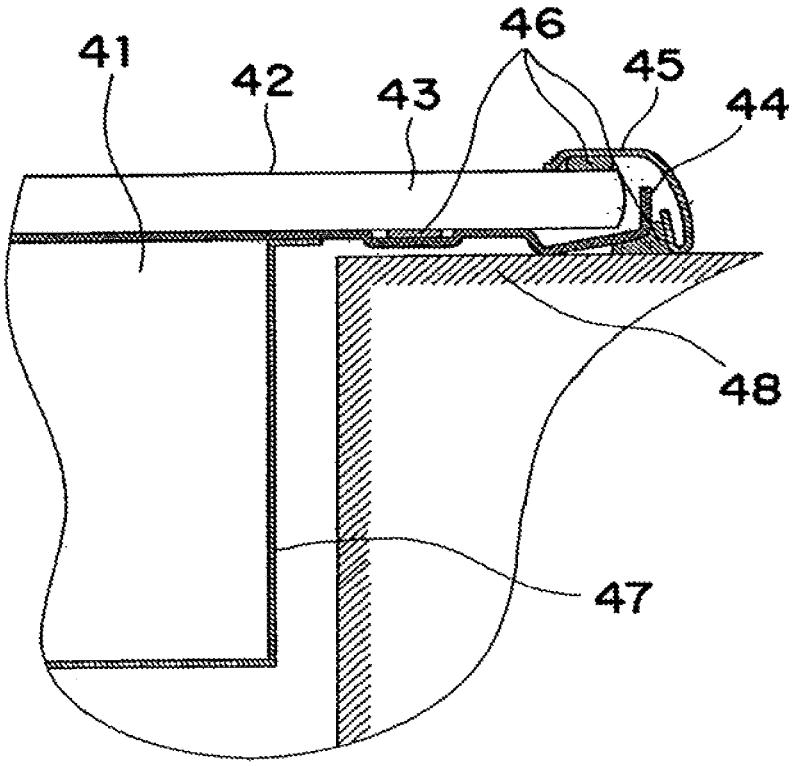

*Fig. 9* Prior Art
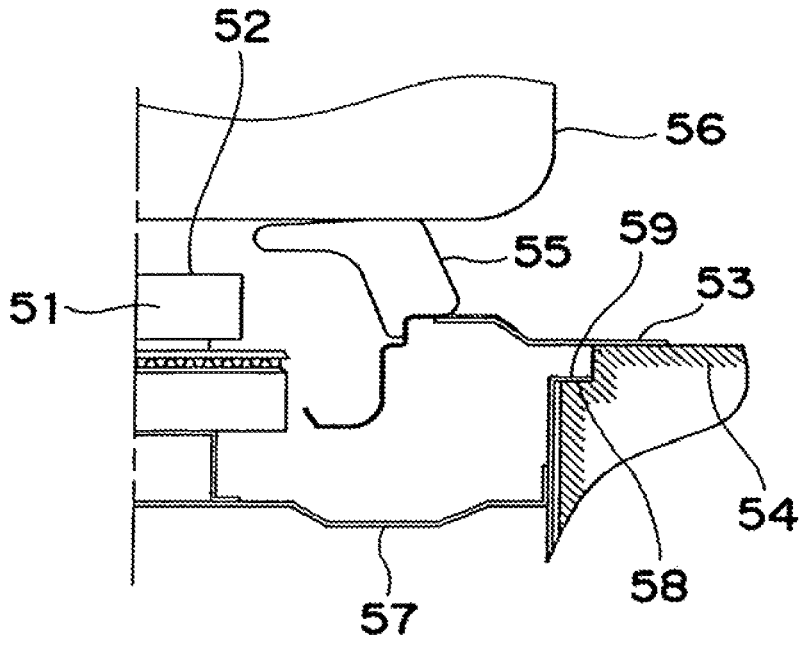

BUILT-IN COOKING APPLIANCE AND KITCHEN COUNTER HAVING SAME

FIELD OF THE INVENTION

The present invention relates to a built-in cooking appliance incorporated into a kitchen counter for a general household and to the kitchen counter into which the cooking appliance has been incorporated.

BACKGROUND ART

A conventional built-in cooking appliance of this kind has a top plate unit shown in FIG. 8, which is a typical one for an induction-heating cooking appliance. As shown therein, the top plate unit includes a top plate sandwiched between an underframe and a frame with predetermined portions of such members bonded to each other. The top plate unit so constructed is placed on a kitchen counter with a lower surface of the underframe held in contact with an upper surface of the counter.

More specifically, as shown in FIG. 8, an induction-heating cooking appliance 41 is provided with a top plate unit 42, which includes an underframe 44, a top plate 43 placed on the underframe 44, and a frame 45 placed on the top plate 43 from above with predetermined portions of such members bonded to each other by means of an adhesive 46. The top plate unit 42 is fixedly mounted on a main body 47 with any suitable tightening means such as screws so as to close an opening defined in the main body 47. When the induction-heating cooking appliance 41 has been incorporated into the counter 48, a lower surface of the underframe 44 of the top plate unit 42 is held in contact with an upper surface of the counter 48, thereby supporting the total weight of the induction-heating cooking appliance 41 and holding the induction-heating cooking appliance 41.

A typical built-in gas cooking stove has been also proposed, having a top plate directly placed on an upper surface of a counter so as to be flush therewith (see, for example, Patent Document 1).

FIG. 9 depicts an example of a conventional built-in cooking appliance as disclosed in Patent Document 1. As shown in FIG. 9, a gas cooking stove 51 includes a gas burner 52 disposed substantially at a central portion thereof, a top plate 53 placed on an upper surface of a kitchen counter 54, and a tripod 55 mounted on the top plate 53 so that a pan or pot may be placed on the tripod 55 and heated by the gas burner 52. The gas cooking stove 51 has a main body 57 and a flange 59 secured thereto and placed on a shoulder portion 58 that is formed in the counter 54 so as to be lower than the upper surface of the counter 54. The flange 59 supports the total weight of the main body 57 and holds the main body 57.

Patent Document 1: Japanese Laid-Open Patent Publication No. 11-166739

DISCLOSURE OF THE INVENTION

Problems to be Solved by the Invention

In the construction as shown in FIG. 8, however, because the top plate 43, the underframe 44, and the frame 45 are fixedly bonded together by means of the adhesive 46, it sometimes occurs that the top plate 43 may sink by its own weight and be separated from the frame 45, thus creating an opening between the top plate 43 and the frame 45. In that case, there is a possibility of water or the like entering the main body 47 due to spillover during cooking.

Further, the top plate unit 42 is made up of the top plate 43, the underframe 44, and the frame 45 stacked one upon another and, hence, the top plate unit 42 has a thickness substantially equal to the total thickness of at least such three component parts. Accordingly, the difference in level between the upper surface of the counter 48 and that of the top plate unit 42 becomes large. Although the upper surface of the top plate 43 is smooth, such difference in level spoils the design of the upper surface of the counter 48, causes dust or dirt to be conspicuously collected, and makes cleaning difficult.

On the other hand, in the construction as shown in FIG. 9, because the top plate 53 is not so thick, the counter 54 can be so constructed as to have an upper surface substantially flush with the upper surface of the top plate 53. Recently, attention is being focused on gas cooking stoves having a top glass of a generally flat cooking surface. However, some of them have a top plate into which a pane of glass is fitted and, hence, the counter 54 cannot have an upper surface substantially flush with the upper surface of the top plate 53.

The present invention has been developed to overcome the above-described disadvantages, and an objective of the present invention is to provide a built-in cooking appliance superior in fastness, design and cleaning properties while preventing water from entering a main body thereof.

Means to Solve the Problems

In accomplishing the above objective, a built-in cooking appliance according to the present invention is provided with a main body that includes a casing having an opening defined therein at an upper portion thereof, a heating source accommodated in the casing, and a top plate unit fixed to the casing so as to close the opening in the casing. The main body is to be inserted into an opening defined in a kitchen counter. The top plate unit includes a top plate on which an object to be heated is placed, an underframe for holding the top plate placed on an upper surface thereof, the underframe having an outer peripheral edge and being adapted to be placed on an upper surface of the kitchen counter in a manner in which a lower surface of the underframe is held in contact with the upper surface of the kitchen counter, and a decorative panel for covering an upper portion of an outer peripheral edge of the top plate. The decorative panel has an inwardly bent portion that has been formed by bending an outer peripheral edge portion of the decorative panel inwardly toward a lower surface of the underframe to hold the outer peripheral edge of the underframe.

At least a portion of the inwardly bent portion is sandwiched between the outer peripheral edge of the underframe and the upper surface of the kitchen counter such that part or all of a total weight of the main body is applied to at least the portion of the inwardly bent portion that is sandwiched between the outer peripheral edge of the underframe and the upper surface of the kitchen counter.

Further, a surface of the underframe on which the top plate is placed may be lower than the upper surface of the kitchen counter on which the decorative panel is placed.

When the main body is inserted into the opening in the kitchen counter, a predetermined clearance may be created between the upper surface of the kitchen counter and the lower surface of the underframe inside the inwardly bent portion of the decorative panel. In this case, a sealant may be provided in the predetermined clearance below the lower surface of the underframe.

The top plate, the underframe, and the decorative panel can be bonded together at the same time. For this purpose, the underframe has a downwardly protruding adhesive receiving groove defined therein below the outer peripheral edge of the top plate, and an adhesive is received in the adhesive receiving groove to bond the top plate, the underframe, and the decorative panel together at the same time.

A kitchen counter having a built-in cooking appliance that is received in an opening defined therein has an upper surface on which the built-in cooking appliance is placed, and a stepped portion formed around the opening so as to be lower than the upper surface. It is preferred that a lower surface of the inwardly bent portion of the decorative panel be held in contact with the upper surface, and a predetermined clearance be provided between a lower surface of a portion of the underframe and the upper surface of the stepped portion. Such a portion of the underframe may be an adhesive receiving groove protruding downwardly from the underframe.

Effects of the Invention

The present invention is constructed in the manner as described hereinabove and offers the following effects.

According to the present invention, because the decorative panel has an inwardly bent portion that has been formed by bending an outer peripheral edge portion of the decorative panel inwardly toward a lower surface of the underframe to hold the outer peripheral edge of the underframe, the top plate is mechanically held by the underframe and the decorative panel, making it possible to prevent the top plate from being separated from the underframe, enhance the fastness of the top plate unit, and prevent water or the like from entering the main body.

If a surface of the underframe on which the top plate is placed is set to be lower than the upper surface of the kitchen counter on which the decorative panel is placed, the difference in level between the upper surface of the top plate and the upper surface of the counter can be considerably reduced such that these surfaces can be made substantially flush with each other. By so doing, not only can the cleaning properties and the handling be enhanced, but the total design of system kitchens can also be enhanced.

Further, if a predetermined clearance is provided between the upper surface of the counter and the lower surface of the underframe, and a sealant is provided in such a predetermined clearance, the opening created between the top plate unit and the counter is minimized, thereby preventing water or dirt from entering the counter without spoiling the design.

If the top plate, the underframe, and the decorative panel are bonded together at the same time, the process of making the top plate unit is simplified, and water or dirt can be blocked in a wide range.

Moreover, in the case where a kitchen counter having a built-in cooking appliance placed thereon has a stepped portion formed around an opening therein so as to be lower than the upper surface, if a lower surface of the inwardly bent portion of the decorative panel is held in contact with the upper surface, and a predetermined clearance is provided between a lower surface of a portion of the underframe and the upper surface of the stepped portion, and if there arises such a situation that the total weight of the cooking appliance cannot be supported, the lower surface of the underframe is brought into contact with the upper surface of the stepped portion. As a result, the total weight of the cooking appliance is supported by such a contact portion and the lower surface of the bent portion, making it possible to enhance the fastness of the cooking appliance as a whole.

BRIEF DESCRIPTION OF THE DRAWINGS

FIG. 8 is a cross-sectional view of an essential portion of a conventional built-in cooking appliance.

FIG. 9 is a cross-sectional view of an essential portion of another conventional built-in cooking appliance.

EXPLANATION OF REFERENCE NUMERALS

Figure 1:
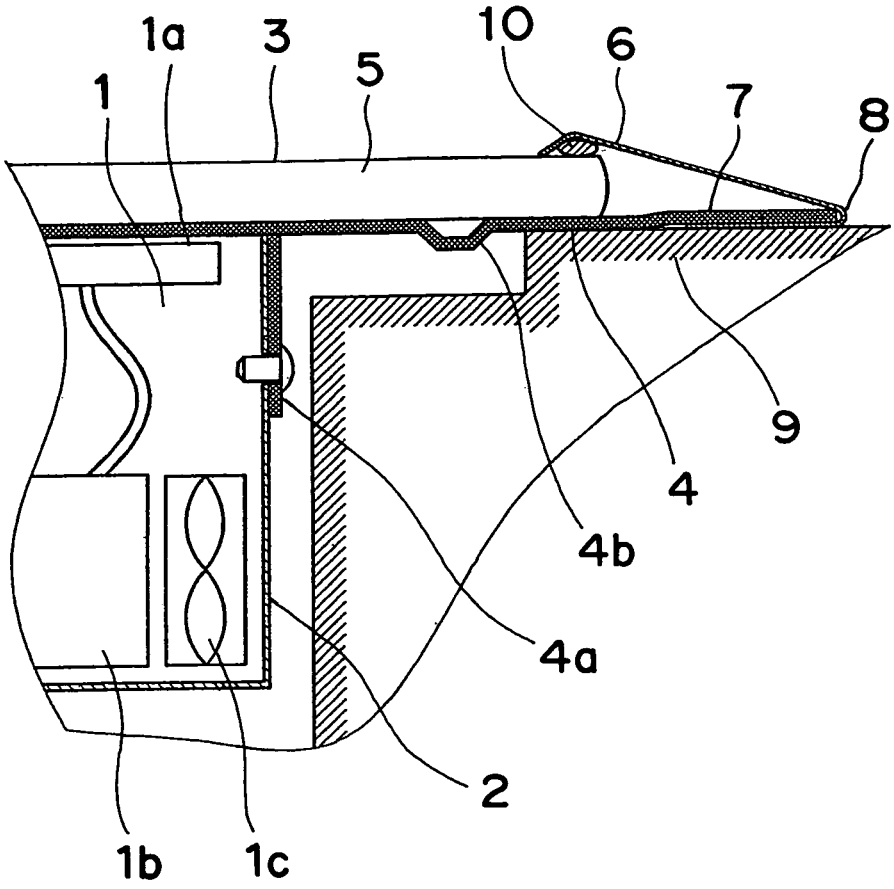
FIG. 1 is a cross-sectional view of an essential portion of a built-in cooking appliance according to a first embodiment of the present invention.

1 induction-heating cooking appliance
1*a* induction-heating coil
1*b* inverter circuit
1*c* cooling device
2 main body casing
2*a* fixing piece
3, 12, 20, 27 top plate unit
3*a* intake port
3*b* exhaust port
4, 13, 21, 26 underframe
4*a* mounting piece
4*b* groove
5 top plate
6, 14, 22 decorative panel
7, 17, 23 flange
8, 15, 24 inwardly bent portion
9, 16 kitchen counter
10 adhesive
18 stepped portion
25 sealing tape
31 recess
32 adhesive

DETAILED DESCRIPTION OF THE INVENTION

Embodiments of the present invention are explained hereinafter with reference to the drawings.

Embodiment 1

Figure 2:
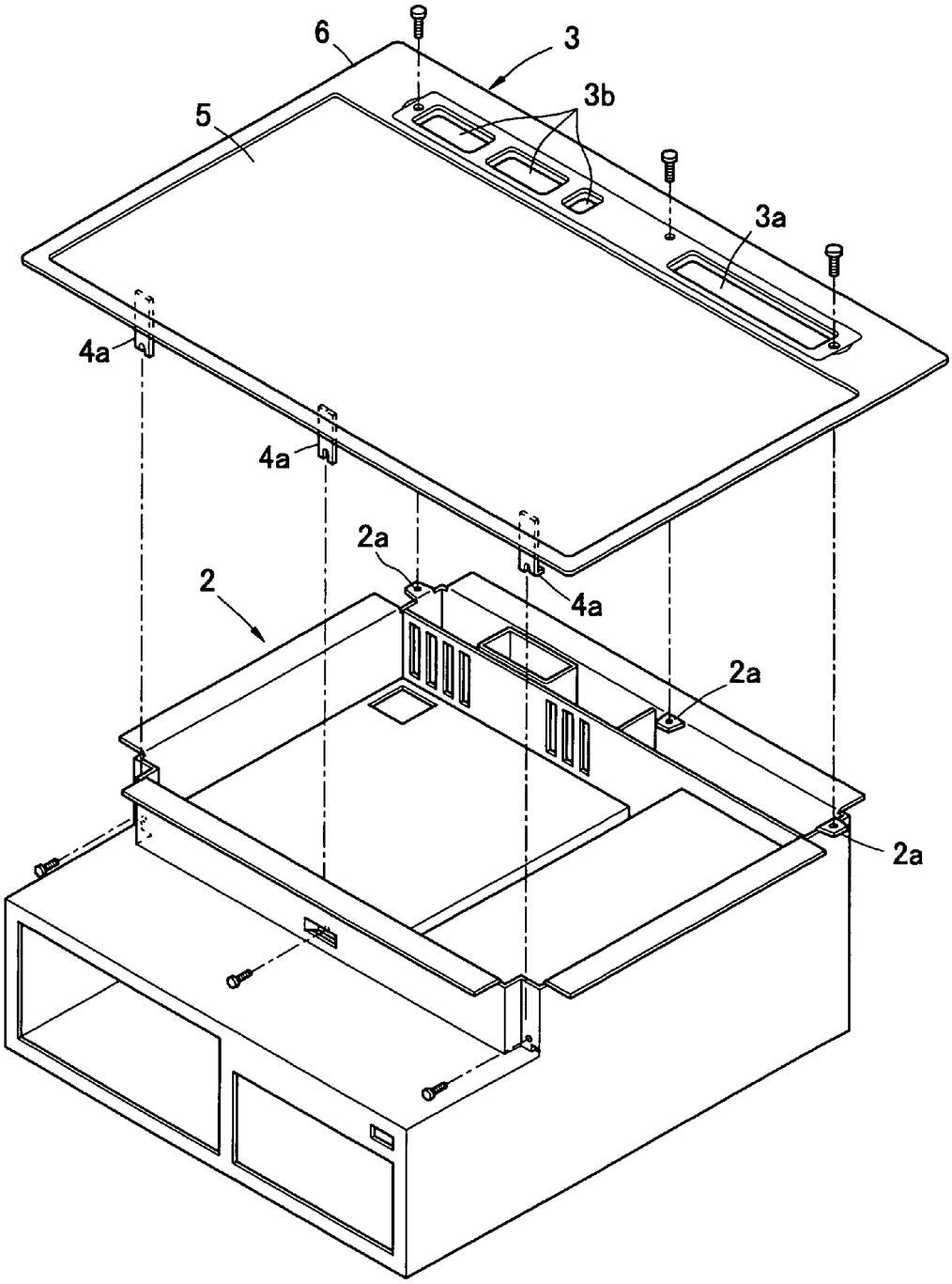
FIG. 2 is a perspective view of a main body casing constituting the cooking appliance of FIG. 1.
Figure 3:
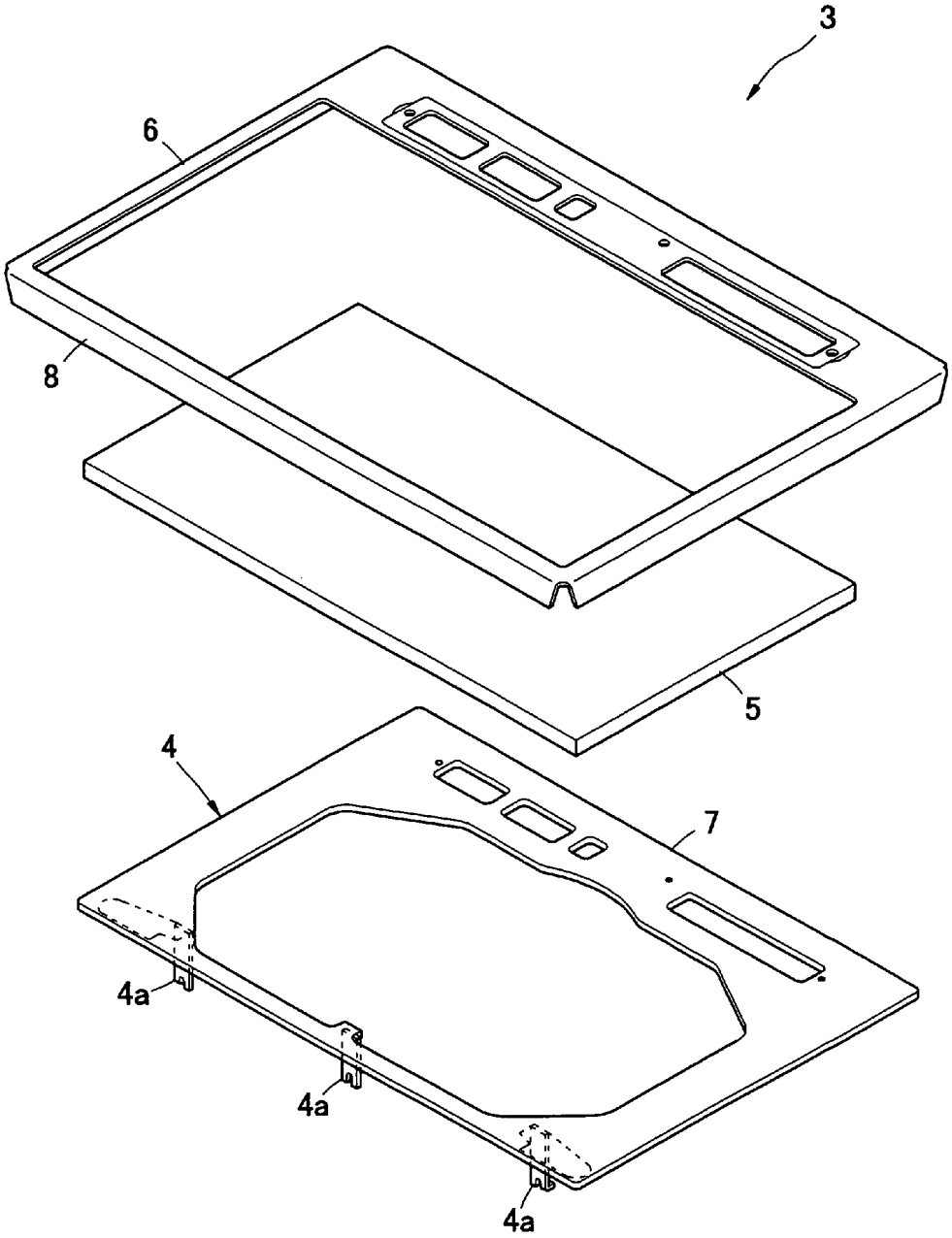
FIG. 3 is an exploded perspective view of a top plate unit constituting the cooking appliance of FIG. 1.

FIG. 1 is a cross-sectional view of an essential portion of a built-in induction-heating cooking appliance according to a first embodiment of the present invention. FIGS. 2 and 3 depict a main body casing and a top plate unit, respectively, both constituting an induction-heating cooking appliance.

As shown in FIGS. 1 to 3, an induction-heating cooking appliance 1 includes a box-shaped main body casing 2 having an upper opening defined therein and a top plate unit 3 fixed to the casing 2 so as to close the upper opening in the casing 2. The top plate unit 3 is fixed to a plurality of (for example, three) fixing pieces 2*a* formed on a rear portion of the casing 2 by screws from above, and the top plate unit 3 has a plurality of (for example, three) mounting pieces 4*a* extending downwardly from a lower surface thereof in proximity to a front edge thereof, which mounting pieces 4*a* are fixed at a free end thereof to the casing 2 by screws.

The casing 2 accommodates therein an induction-heating coil 1*a* for induction-heating an object to be heated (for example, a metal pan) that is placed on the top plate unit 3, an inverter circuit 1*b* for supplying the induction-heating coil 1*a* with a high-frequency current, and a cooling device 1*c* for cooling internal component parts including the induction-heating coil 1*a* and the inverter circuit 1*b*.

The top plate unit 3 is constructed such that a top plate 5 made of an electric insulating plate such as ceramic is sandwiched between a plaque or decorative panel 6 made of a stainless plate in the form of a frame and an underframe 4 made of a rigid metallic material such as an iron plate. The top plate unit 3 has an intake port 3*a* and a plurality of exhaust ports 3*b* defined therein and, hence, each of the underframe 4 and the decorative panel 6 has corresponding openings defined therein.

FIG. 3 depicts the top plate unit 3 before assemblage. As shown therein, an outer edge portion 8 of the decorative panel 6 is first bent downwardly so as to form a right angle with respect to an upper surface of the top plate 5, and is further bent toward a lower surface of the underframe 4 after assemblage of the top plate unit 3. When the top plate 5 is placed on the underframe 4, an adhesive is applied to a predetermined portion (in FIG. 1, a recess or groove 4*b* formed by pressing) of the underframe 4 positioned outwardly of the casing 2 to bond the underframe 4 and the top plate 5 to each other.

The underframe 4 is so formed as to extend outwardly beyond an entire outer peripheral edge of the top plate 5. The decorative panel 6 has a ridge formed at an inner portion thereof, an inwardly inclined portion formed inwardly of the ridge, and an outwardly inclined portion formed outwardly of the ridge. An inner edge of the inwardly inclined portion is held in contact with an upper surface of the top plate 5, while the outwardly inclined portion is bent downwardly and inwardly at an outer edge of the underframe 4 by caulking so as to extend along and contact with a lower surface of the underframe 4. An adhesive 10 is applied to the upper surface of the top plate 5 along the outer peripheral edge thereof so as to be interposed between the decorative panel 6 and the top plate 5. The underframe 4 has a flange 7 formed therewith at an outer peripheral portion thereof, and no clearance is present between the flange 7 and the bent portion of the decorative panel 6 that is positioned below the flange 7.

The induction-heating cooking appliance constructed in the above-described manner is placed in position by placing the lower surface of the top plate unit 3 on an upper surface of a kitchen counter 9. The operation and effects of the induction-heating cooking appliance are explained hereinafter.

The top plate 5 and the decorative panel 6 are sealed entirely by the adhesive 10, which in turn acts to prevent water or dirty liquid on a cooking surface from entering the casing 2. The top plate 5 and the underframe 4 are bonded together by the adhesive applied to the predetermined position located outwardly of the casing 2. The decorative panel 6 is in the form of a frame and has an inner edge that presses the top plate 5 from above. As described above, the decorative panel 6 also has the inwardly bent portion that is bent inwardly at the entire outer edge 8 of the underframe 4 by caulking such that the entire outer edge portion of the underframe 4 may be covered with the decorative panel 6. Accordingly, the top plate 5 is mechanically fixed to the underframe 4 and, hence, even if the adhesive deteriorates and comes to have a reduced bonding force, or even if a strong separating force acts between the top plate 5 and the underframe 4, the top plate 5 will not be separated from the underframe 4 and a clearance will not be created between the top plate 5 and the decorative panel 6, making it possible to prevent water or dirt on the cooking surface from entering the casing 2. In particular, in the case of bonding of metallic component parts made by pressing or the like, incomplete removal of a processing oil adhering to surfaces thereof has a great influence on the bonding property. Unlike the conventional construction that depends on only the bonding, the present invention can enhance the fastness and the sealing properties of the top plate unit 3, making it possible to stabilize quality.

Although the first embodiment of the present invention has been explained by way of a built-in induction-heating cooking appliance, even if the construction of the top plate unit explained in this embodiment is applied to a built-in cooking apparatus having a heat-resisting glass on an upper surface thereof and a heating source such as a radiant heater or gas, similar operation and effects are provided.

Embodiment 2

Figure 4:
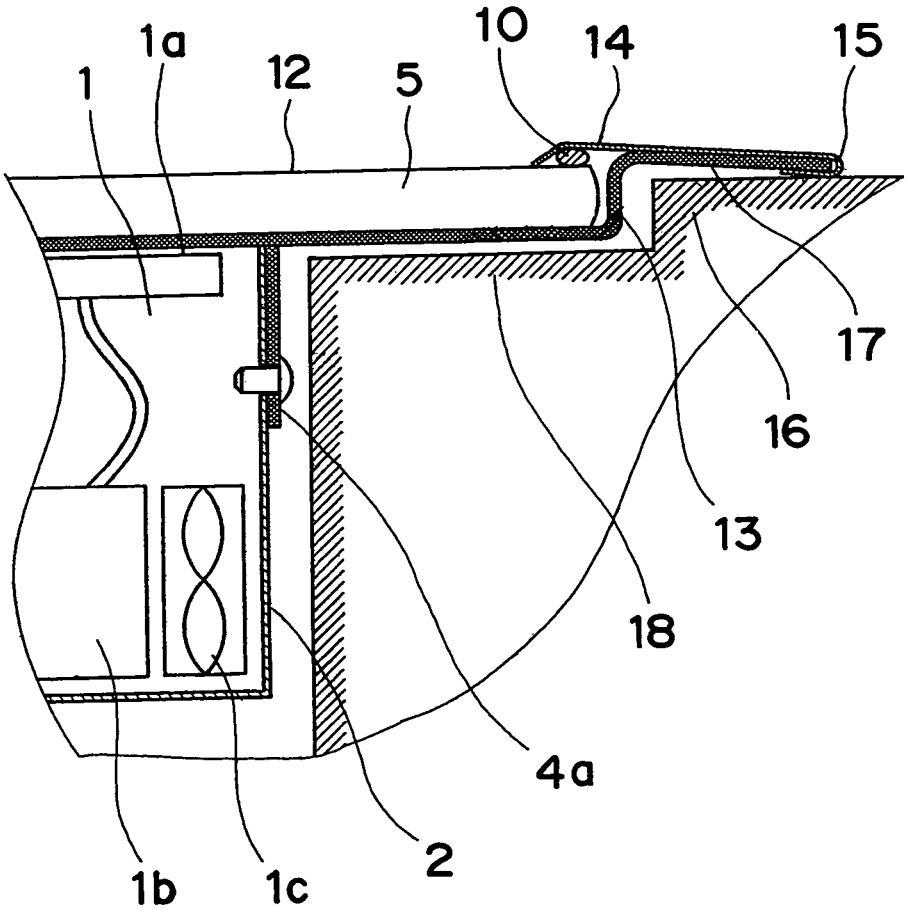
FIG. 4 is a cross-sectional view of an essential portion of a built-in cooking appliance according to a second embodiment of the present invention.

FIG. 4 is a cross-sectional view of an essential portion of a built-in induction-heating cooking appliance according to a second embodiment of the present invention. Because the fundamental construction of the second embodiment is the same as that of the first embodiment, duplicative explanation thereof is omitted, and differences therebetween are mainly discussed. Component parts having the same function as those in the first embodiment are designated by the same reference numerals, and duplicative explanation thereof is omitted.

In the construction of the top plate unit 3 according to the first embodiment as shown in FIG. 1, the level of the surface of the underframe 4 on which the top plate 5 is placed is higher than the level of the counter surface on which the underframe 4 and the inwardly bent portion of the decorative panel 6 are placed. On the other hand, in this embodiment as shown in FIG. 4, an underframe 13 is bent upwardly at a location outwardly of the outer peripheral edge of the top plate 5 and is then bent outwardly at a level higher than the upper surface of the top plate 5 to form a generally horizontally extending flange 17, which is in turn placed on a counter 16. By this construction, a surface of the underframe 13 on which the top plate 5 is placed is lower than an upper surface of the counter 16 on which a bent portion of a decorative panel 14 is placed. The second embodiment differs from the first embodiment in this point.

The second embodiment also differs from the first embodiment in the following points: the decorative panel 14 is held in close contact with upper and lower surfaces of the flange 17, the flange 17 is so inclined as to lower outwardly, and the counter 16 has a generally horizontally extending stepped portion 18 lower than the upper surface thereof to accommodate the top plate 5 in a space above the stepped portion 18.

The operation and effects of the built-in induction-heating cooking appliance of the above-described construction are explained hereinafter.

Because the surface of the underframe 13 on which the top plate 5 is placed is lower than the upper surface of the counter 16 on which the bent portion of the decorative panel 14 is placed, the flange 17 of the underframe 13 can be positioned at a level close to the level of the upper surface of the top plate 5, as shown in FIG. 4. Accordingly, the upper surface of the decorative panel 14 can be lowered by the thickness of the top plate 5 and, hence, the level of the upper surface of a top plate unit 12 as measured from the upper surface of the counter 16 can be considerably lowered, thereby enhancing the cleaning operation of the upper surface, the handling during cooking, and the design of the induction-heating cooking appliance.

Further, the construction in which the lower surface of the bent portion 15 is placed on the upper surface of the counter 16 while supporting part or all of the total weight of the induction-heating cooking appliance 1 can reduce the clearance between the upper surface of the counter 16 and the outer peripheral portion of the top plate unit 12, making it possible to enhance the above-described effects.

In addition, the clearance between the lower surface of the underframe 13 and the upper surface of the stepped portion 18 is set to a predetermined value, and the total weight of the induction-heating cooking appliance 1 is normally supported by the lower surface of the bent portion 15, but if there arises such a situation that the total weight of the induction-heating cooking appliance 1 cannot be supported by the lower surface of the bent portion 15 for some reasons (for example, an unexpected heavy object is placed on the cooking surface), the top plate 5 of which the upper surface is the cooking surface sinks. In this event, the lower surface of the underframe 13 is brought into contact with the upper surface of the stepped portion 18. As a result, the total weight of the induction-heating cooking appliance 1 is supported by such a contact portion and the lower surface of the bent portion 15, making it possible to avoid an unexpected accident.

It is to be noted that the shape of the underframe 13 and that of the decorative panel 14 are not limited to those in the second embodiment, but any other suitable shapes can be used, by changing aspects which need to be changed, unless such shapes otherwise depart from the scope of the second embodiment.

Embodiment 3

Figure 5:
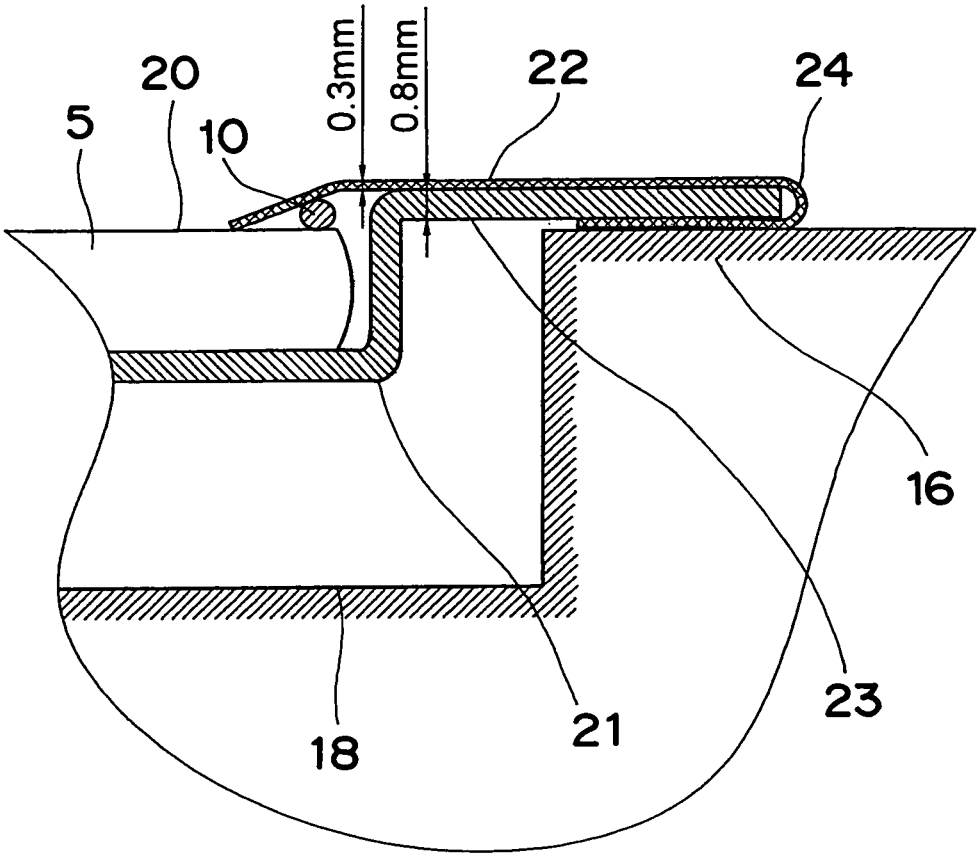
FIG. 5 is a cross-sectional view of an essential portion of a built-in cooking appliance according to a third embodiment of the present invention.

FIG. 5 is a cross-sectional view of an essential portion of a built-in induction-heating cooking appliance according to a third embodiment of the present invention. Because the fundamental construction of the third embodiment is the same as that of the second embodiment, duplicative explanation thereof is omitted. Component parts having the same function as those in the second embodiment are designated by the same reference numerals, and duplicative explanation thereof is omitted.

The third embodiment differs from the second embodiment in the following points: a flange 23 formed with an underframe 21 of a top plate unit 20 is not inclined but extends horizontally, and the material and size of the underframe 21 and those of a decorative panel 22 are specified.

As shown in FIG. 5, a hot-dip galvanized steel plate having a thickness of 0.8 mm is selected as the material of the underframe 21 constituting the top plate unit 20, while a SUS304 stainless steel having a thickness of 0.3 mm and a No. 4 surface finish is selected as the material of the decorative panel 22 constituting the top plate unit 20. The decorative panel 22 is superimposed on the flange 23 so as to be held in close contact therewith and is bent downwardly and inwardly at a predetermined position 24 by pressing and by subsequent caulking so that both of them may be united together with the inwardly bent portion of the decorative panel 22 positioned below the flange 23.

The operation and effects of the built-in induction-heating cooking appliance of the above-described construction are explained hereinafter.

By setting the thickness of the decorative panel 22 to 0.3 mm, by bending downwardly and then inwardly the entire outer peripheral portion of the decorative panel 22 at the outer edge of the flange 23, and by subsequently caulking the decorative panel 22 with respect to the flange 23, bending of the decorative panel 22 can be easily carried out so that the decorative panel 22 may be held in close contact with the surface of the flange 23. Because the decorative panel 22 serves as an ornamental component part, the selection of a SUS304 stainless steel and a No. 4 surface finish can enhance the design without any rust. Further, the selection of a hot-dip galvanized steel plate having a thickness of 0.8 mm as the material of the underframe 21 can enhance the workability and the fastness.

It is preferred that the thickness of the decorative panel 22 of the aforementioned material be in the range of 0.2 mm to 0.7 mm and that the thickness of the underframe 21 be in the range of 0.5 mm to 1.1 mm. In order to enhance the design, the decorative panel 22 may be a hot-dip galvanized steel plate of which the surface has been fluorinated. It is also preferred that the decorative panel 22 be made as thin as possible so as to have a thickness of 30% to 50% of that of the underframe 21.

Embodiment 4

Figure 6:
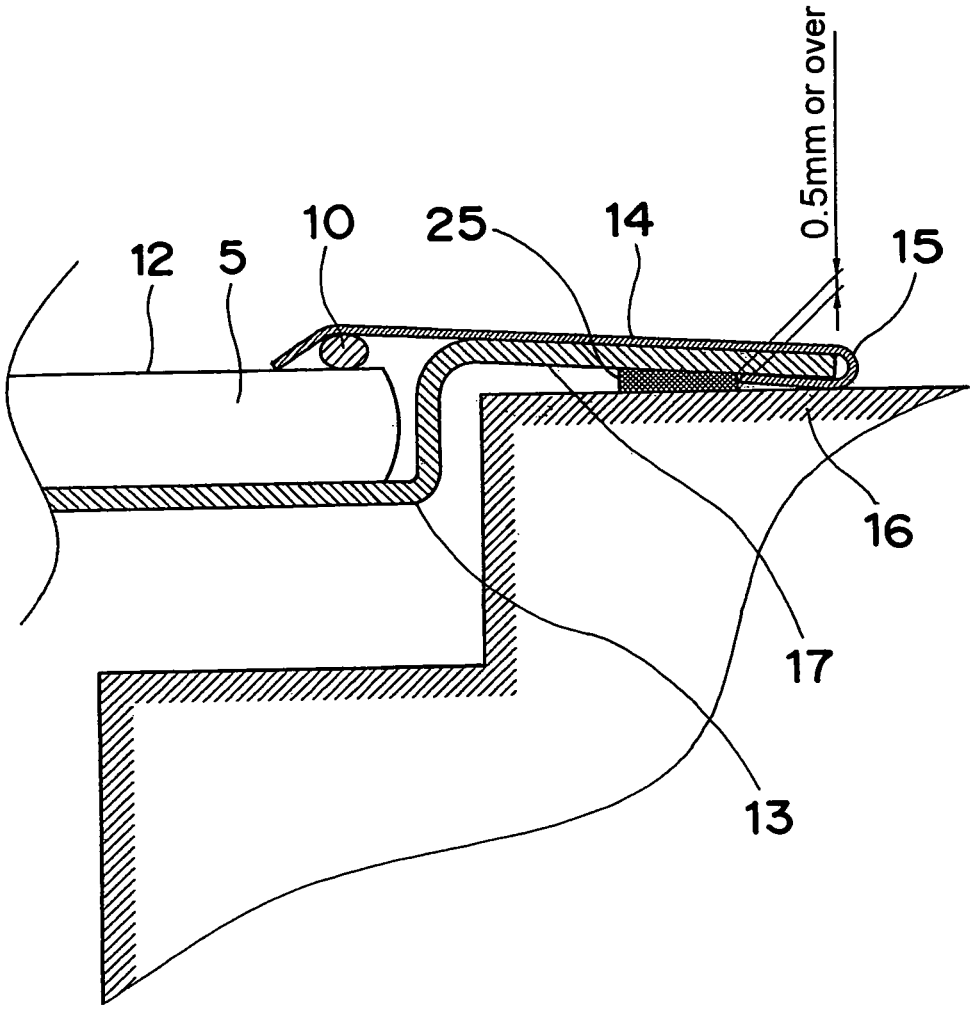
FIG. 6 is a cross-sectional view of an essential portion of a built-in cooking appliance according to a fourth embodiment of the present invention.

FIG. 6 is a cross-sectional view of an essential portion of a built-in induction-heating cooking appliance according to a fourth embodiment of the present invention. Because the fundamental construction of the fourth embodiment is the same as that of the second embodiment, duplicative explanation thereof is omitted, and differences therebetween are mainly discussed. Component parts having the same function as those in the second embodiment are designated by the same reference numerals, and duplicative explanation thereof is omitted.

In this embodiment as shown in FIG. 6, when the main body is inserted into an opening defined in the counter, a predetermined clearance is formed between the upper surface of the counter 16 and the lower surface of the flange 17 of the underframe 13 inside the inwardly bent portion. A sealant 25 is provided in the predetermined clearance below the flange 17. When the bent portion 15 is placed on the upper surface of the counter 16, a clearance greater than 0.5 mm is ensured between the lower surface of the flange 17 (except the inwardly bent portion) and the upper surface of the counter 16. A sealing tape made of urethane foam and having a width of 5 mm, a height of 5 mm, and a maximum amount of compression of 4.5 mm is employed as the sealant 25 and is applied to the lower surface of the flange 17 at the aforementioned portion.

The operation and effects of the induction-heating cooking appliance of the above-described construction are explained hereinafter.

By applying the urethane foam sealing tape 25 having a maximum amount of compression of 4.5 mm to the lower surface of the flange 17 inside the inwardly bent portion, when the induction-heating cooking appliance 1 is incorporated into the counter 16, the urethane foam sealing tape 25 is compressed by the weight of the induction-heating cooking appliance 1 and comes to have a thickness of about 0.5 mm after compression. Because the lower surface of the flange 17 is spaced a distance of 0.5 mm or over from the upper surface of the counter 16 at a location inside the inwardly bent portion, the lower surface of the bent portion 15 does not rise, i.e., no opening is created between it and the upper surface of the counter 16, making it possible to enhance the design and prevent water or dirt from entering the counter 16.

It is to be noted that although in the above-described fourth embodiment the sealant 25 has been described as being a sealing tape made of urethane foam, any other suitable material or means can be used if it provides similar operation and effects. Further, although the sealing tape 25 is applied to the lower surface of the flange 17, it may be applied to the counter 16.

Embodiment 5

Figure 7:
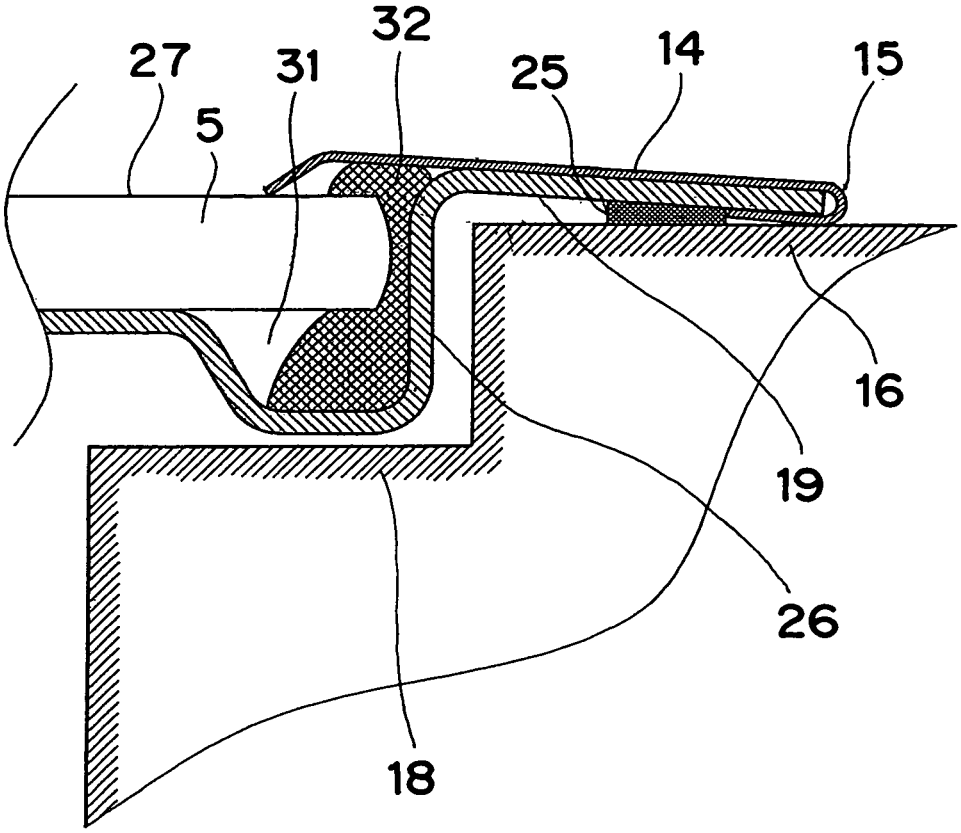
FIG. 7 is a cross-sectional view of an essential portion of a built-in cooking appliance according to a fifth embodiment of the present invention.

FIG. 7 is a cross-sectional view of an essential portion of a built-in induction-heating cooking appliance according to a fifth embodiment of the present invention. Because the fundamental construction of the fifth embodiment is the same as that of the second embodiment, explanation thereof is omitted, and differences therebetween are mainly discussed. Component parts having the same function as those in the second embodiment are designated by the same reference numerals, and explanation thereof is omitted.

This embodiment as shown in FIG. 7 differs in construction from the second embodiment in the following points: an underframe 26 has a recess (adhesive receiving groove) 31 defined therein below the outer peripheral edge of the top plate 5 so as to protrude downwardly so that the top plate 5, the underframe 26, and the decorative panel 14 may be bonded together by an adhesive received in the recess 31, and a sealing tape 25 employed as a sealant is provided in the manner similar to that shown in FIG. 6. That is, in the case where the downwardly protruding recess 31 is formed in the underframe 26 at a location below the outer peripheral edge of the top plate 5 constituting a top plate unit 27, the top plate 5, the underframe 26, and the decorative panel 14 can be bonded together at the same time by first putting a predetermined amount of adhesive 32 into the recess 31, by subsequently placing the top plate 5 on the underframe 26, and by placing the decorative panel 14 on a flange 19 of the underframe 26. Thereafter, the decorative panel 14 is bent at a predetermined position 15.

The operation and effects of the induction-heating cooking appliance of the above-described construction are explained hereinafter.

As described above, after a predetermined amount of adhesive 32 has been put into the downwardly protruding recess 32 formed in the underframe 26 at a location below the outer peripheral edge of the top plate 5, the top plate 5 is placed on the underframe 26, and the decorative panel 14 is then placed on the flange 19 of the underframe 26 before the top plate 5, the underframe 26, and the decorative panel 14 are bonded together at the same time. Accordingly, the process of making the top plate unit 27 is simplified, and water or dirt on the cooking surface, i.e., the upper surface of the top plate 5 can be blocked in a wide range, making it possible to prevent water or dirt from entering the casing 2.

In the above-described construction, the counter 16 may have a generally horizontally extending stepped portion 18 lower than the upper surface thereof to accommodate the top plate 5 in a space above the stepped portion 18, and the clearance between the lower surface of the recess 31 and the upper surface of the stepped portion 18 is set to a predetermined value. In this case, the total weight of the induction-heating cooking appliance 1 is normally supported by the lower surface of the bent portion 15, but if there arises such a situation that the total weight of the induction-heating cooking appliance 1 cannot be supported by the lower surface of the bent portion 15 for some reasons, the top plate 5 of which the upper surface is the cooking surface sinks. In this event, the lower surface of the recess 31 is brought into contact with the upper surface of the stepped portion 18, and the total weight of the induction-heating cooking appliance 1 is supported by such a contact portion and the lower surface of the bent portion 15.

INDUSTRIAL APPLICABILITY

As described hereinabove, the present invention can be applied to all the built-in cooking appliances of a flat design having a heat-resisting glass on a cooking surface.

The invention claimed is:

1. A built-in cooking appliance comprising a main body that includes a casing having an opening defined therein at an upper portion thereof, a heat source accommodated in the casing, and a top plate unit fastened to the casing so as to close the opening in the casing, the main body being adapted to be inserted into an opening defined in a kitchen counter such that a lower surface of the top plate unit is placed on the kitchen counter, wherein the top plate unit includes:

a top plate for supporting an object to be heated;

an underframe holding the top plate placed on an upper surface thereof, the underframe extending outwardly beyond an entire outer peripheral edge of the top plate, wherein the underframe is fastened to the casing and has an outer peripheral edge to be supported by the kitchen counter such that the outer peripheral edge is arranged to confront an upper surface of the kitchen counter; and a decorative panel covering an upper portion of the outer peripheral edge of the top plate, wherein the decorative panel has an inwardly bent portion that has been formed by bending an outer peripheral edge portion of the decorative panel inwardly toward a lower surface of the underframe to hold the outer peripheral edge of the underframe, and wherein the outer peripheral edge portion of the decorative panel is bent such that an outer peripheral edge of the decorative panel is immediately below and in direct contact with a portion of the outer peripheral edge of the underframe.

2. The built-in cooking appliance according to claim 1 in combination with the kitchen counter so that the built-in cooking appliance is received in an opening defined in the kitchen counter, wherein at least a portion of the inwardly bent portion is sandwiched between the outer peripheral edge of the underframe and the upper surface of the kitchen counter such that part or all of a total weight of the main body is applied to the portion of the inwardly bent portion that is sandwiched between the outer peripheral edge of the underframe and the upper surface of the kitchen counter.

3. The built-in cooking appliance according to claim 1 in combination with the kitchen counter so that the built-in cooking appliance is received in an opening defined in the kitchen counter, wherein a surface of the underframe on which the top plate is placed is lower than the upper surface of the kitchen counter on which the decorative panel is placed.

4. The built-in cooking appliance according to claim 1 in combination with the kitchen counter so that the built-in cooking appliance is received in an opening defined in the kitchen counter, wherein when the main body is inserted into the opening in the kitchen counter, wherein a predetermined clearance is created between the upper surface of the kitchen counter and the lower surface of the underframe inside the inwardly bent portion of the decorative panel, and wherein a sealant is provided in the predetermined clearance below the lower surface of the underframe.

5. The built-in cooking appliance according to claim 1, wherein the top plate, the underframe, and the decorative panel are bonded together.

6. The built-in cooking appliance according to claim 5, wherein the underframe has a downwardly protruding adhesive receiving groove defined therein below the outer peripheral edge of the top plate, and further comprising an adhesive received in the adhesive receiving groove to bond the top plate, the underframe, and the decorative panel together.

7. The built-in cooking appliance according to claim 6 in combination with the kitchen counter so that the built-in cooking appliance is received in an opening defined in the kitchen counter, the kitchen counter comprising:

an upper surface on which the built-in cooking appliance is placed; and a stepped portion formed around the opening so as to be lower than the upper surface of the kitchen counter, wherein a lower surface of the inwardly bent portion of the decorative panel is held in contact with the upper surface of the kitchen counter, and a predetermined clearance is provided between a lower surface of the adhesive receiving groove and the upper surface of the stepped portion.

8. The built-in cooking appliance according to claim 1 in combination with the kitchen counter so that the built-in cooking appliance is received in an opening defined in the kitchen counter, the kitchen counter comprising:

an upper surface on which the built-in cooking appliance is placed; and a stepped portion formed around the opening so as to be lower than the upper surface of the kitchen counter, wherein a lower surface of the inwardly bent portion of the decorative panel is held in contact with the upper surface of the kitchen counter, and a predetermined clearance is provided between a lower surface of the underframe and the upper surface of the stepped portion.

9. The built-in cooking appliance according to claim 1 in combination with the kitchen counter so that the built-in cooking appliance is received in an opening defined in the kitchen counter, wherein a lower surface of the underframe faces the upper surface of the kitchen counter, and wherein the outer peripheral edge portion of the decorative panel is sandwiched between the lower surface of the underframe and the upper surface of the kitchen counter.

10. The built-in cooking appliance according to claim 1 in combination with the kitchen counter so that the built-in cooking appliance is received in an opening defined in the kitchen counter, wherein a lower surface of the underframe faces the upper surface of the kitchen counter, and wherein the outer peripheral edge portion of the decorative panel contacts the lower surface of the underframe and the upper surface of the kitchen counter.

11. The built-in cooking appliance according to claim 1 in combination with the kitchen counter so that the built-in cooking appliance is received in an opening defined in the kitchen counter, wherein the underframe is disposed between the heat source and the top plate.

12. The built-in cooking appliance according to claim 1 in combination with the kitchen counter so that the built-in cooking appliance is received in an opening defined in the kitchen counter, wherein the top plate unit is screwed to the casing.

13. A built-in cooking appliance comprising a main body that includes a casing having an opening defined therein at an upper portion thereof, a heat source accommodated in the casing, and a top plate unit fastened to the casing so as to close the opening in the casing, the main body being adapted to be inserted into an opening defined in a kitchen counter such that a lower surface of the top plate unit is placed on the kitchen counter, wherein the top plate unit includes:

a top plate for supporting an object to be heated;

an underframe supporting the top plate placed on an upper surface thereof, the underframe extending outwardly beyond an entire outer peripheral edge of the top plate, wherein the underframe is fastened to the casing and has an outer peripheral edge supported by the kitchen counter such that the outer peripheral edge is arranged to face an upper surface of the kitchen counter and support the top plate unit on the upper surface of the kitchen counter; and a decorative panel covering an upper portion of the outer peripheral edge of the top plate, wherein an inner peripheral edge of the decorative panel is connected to an upper surface of the top plate, wherein an outer peripheral edge of the decorative panel is bent around the underframe and contacts a lower surface of the underframe such that the decorative panel holds the underframe, and wherein the outer peripheral edge portion of the decorative panel is bent such that an outer peripheral edge of the decorative panel is immediately below and in direct contact with a portion of the outer peripheral edge of the underframe.

14. The built-in cooking appliance according to claim 13 in combination with the kitchen counter so that the built-in cooking appliance is received in an opening defined in the kitchen counter, wherein at least a portion of the inwardly bent portion is sandwiched between the outer peripheral edge of the underframe and the upper surface of the kitchen counter such that part or all of a total weight of the main body is applied to the portion of the inwardly bent portion that is sandwiched between the outer peripheral edge of the underframe and the upper surface of the kitchen counter.

15. The built-in cooking appliance according to claim 13 in combination with the kitchen counter so that the built-in cooking appliance is received in an opening defined in the kitchen counter, wherein a surface of the underframe on which the top plate is placed is lower than the upper surface of the kitchen counter on which the decorative panel is placed.

16. The built-in cooking appliance according to claim 13 in combination with the kitchen counter so that the built-in cooking appliance is received in an opening defined in the kitchen counter, wherein when the main body is inserted into the opening in the kitchen counter, wherein a predetermined clearance is created between the upper surface of the kitchen counter and the lower surface of the underframe inside the inwardly bent portion of the decorative panel, and wherein a sealant is provided in the predetermined clearance below the lower surface of the underframe.

17. The built-in cooking appliance according to claim 13, wherein the top plate, the underframe, and the decorative panel are bonded together, and wherein the underframe has a downwardly protruding adhesive receiving groove defined therein below the outer peripheral edge of the top plate, and further comprising an adhesive received in the adhesive receiving groove to bond the top plate, the underframe, and the decorative panel together.

18. The built-in cooking appliance according to claim 13 in combination with the kitchen counter so that the built-in cooking appliance is received in an opening defined in the kitchen counter, the kitchen counter comprising:

an upper surface on which the built-in cooking appliance is placed; and a stepped portion formed around the opening so as to be lower than the upper surface of the kitchen counter, wherein a lower surface of the inwardly bent portion of the decorative panel is held in contact with the upper surface of the kitchen counter, and a predetermined clearance is provided between a lower surface of the underframe and the upper surface of the stepped portion.

19. The built-in cooking appliance according to claim 18 in combination with the kitchen counter so that the built-in cooking appliance is received in an opening defined in the kitchen counter, the kitchen counter comprising:

an upper surface on which the built-in cooking appliance is placed; and a stepped portion formed around the opening so as to be lower than the upper surface of the kitchen counter, wherein a lower surface of the inwardly bent portion of the decorative panel is held in contact with the upper surface of the kitchen counter, and a predetermined clearance is provided between a lower surface of the adhesive receiving groove and the upper surface of the stepped portion.

20. A kitchen counter having an opening defined therein, an upper surface, and a built-in cooking appliance received in the opening, the built-in cooking appliance comprising a main body that includes a casing having an opening defined therein at an upper portion thereof, a heat source accommodated in the casing, and a top plate unit fastened to the casing so as to close the opening in the casing, the main body being adapted to be inserted into the opening defined in the kitchen counter such that a lower surface of the top plate unit is placed on the kitchen counter, wherein the top plate unit includes:

a top plate for supporting an object to be heated;

an underframe supporting the top plate placed on an upper surface thereof, the underframe extending outwardly beyond an entire outer peripheral edge of the top plate, wherein the underframe is fastened to the casing and has an outer peripheral edge supported by the kitchen counter such that the outer peripheral edge faces an upper surface of the kitchen counter and wherein the underframe supports the top plate on the upper surface of the kitchen counter; and a decorative panel covering an upper portion of the outer peripheral edge of the top plate, wherein an inner peripheral edge of the decorative panel is connected to an upper surface of the top plate, wherein an outer peripheral edge of the decorative panel is bent around the underframe and contacts a lower surface of the underframe such that the decorative panel holds the top plate to the underframe, and wherein a lower surface of the underframe faces the upper surface of the kitchen counter, and the outer peripheral edge portion of the decorative panel is sandwiched between and in direct contact with a portion of the outer peripheral edge of the underframe on the lower surface of the underframe supported by the kitchen counter and the upper surface of the kitchen counter.

* * * * *